US010573203B2

(12) United States Patent
Kershner et al.

(10) Patent No.: US 10,573,203 B2
(45) Date of Patent: Feb. 25, 2020

(54) GIFT CARD PRESENTER FOR GREETING CARDS

(71) Applicant: Hallmark Cards, Incorporated, Kansas City, MO (US)

(72) Inventors: Patrick William Kershner, Overland Park, KS (US); Adam M. Cannon, Kansas City, MO (US); Ginny Neile Walkington, Peculiar, MO (US); Michael Wayne Thomas, Shawnee, KS (US); Emily Byerly Bronson, Overland Park, KY (US); Mark E. Franzke, Prairie Village, KS (US); Ramon Orestes Olivera, Lenexa, KS (US); Thomas A. Wallen, Merriam, KS (US); Madeline Eleanore Tompkins, Kansas City, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 16/200,221

(22) Filed: Nov. 26, 2018

(65) Prior Publication Data

US 2019/0108774 A1 Apr. 11, 2019

Related U.S. Application Data

(63) Continuation of application No. 14/669,862, filed on Mar. 26, 2015, now Pat. No. 10,140,890.
(Continued)

(51) Int. Cl.
*G09F 1/10* (2006.01)
*B42D 15/08* (2006.01)
(Continued)

(52) U.S. Cl.
CPC ..... *G09F 1/10* (2013.01); *B42D 15/042* (2013.01); *B42D 15/045* (2013.01);
(Continued)

(58) Field of Classification Search
CPC ..... G09F 1/10; G09F 1/04; B65D 5/5286;
B42D 15/085; B42D 15/045; B42D 25/285; B42D 15/042
See application file for complete search history.

(56) References Cited

U.S. PATENT DOCUMENTS 448,470 A 3/1891 Barstow
1,317,946 A 10/1919 Snivelt
(Continued)

FOREIGN PATENT DOCUMENTS

EP 220827 A1 5/1987
JP 2013107309 A 6/2013

OTHER PUBLICATIONS

Day 56 Making a Bookmark daily, Feb. 9, 2013, 4 pages. http://lazylizardstudio.blogspot.com/2013_02_01_archive.html.

*Primary Examiner* — Cassandra Davis
(74) *Attorney, Agent, or Firm* — Shook, Hardy & Bacon L.L.P.

(57) ABSTRACT

A gift card presenter for holding a gift card within a greeting card is provided. The presenter comprises a body for holding the gift card, and a coupling element for coupling the body to the greeting card. In one embodiment, the presenter may comprise a paper mechanic coupled to first and second interior faces of the greeting card, the paper mechanic configured to hold the greeting card and display it when the greeting card is opened. In another embodiment, the presenter comprises a body for holding the gift card, the body having a first half and a second half that each include interior and exterior faces. The presenter may be opened to display or partially display the greeting card. The presenter may be
(Continued)

coupled to the inside and/or the outside of the greeting card, to provide a pleasing presentation of the gift card given with the greeting card.

14 Claims, 10 Drawing Sheets

Related U.S. Application Data

(60) Provisional application No. 61/971,414, filed on Mar. 27, 2014.

(51) Int. Cl.

| | |
|---|---|
| ***B42D 25/20*** | (2014.01) |
| ***B42D 15/04*** | (2006.01) |
| ***B65D 5/52*** | (2006.01) |
| ***G09F 1/04*** | (2006.01) |

(52) U.S. Cl.

CPC ..... *B42D 15/085* (2013.01); *B42D 25/285* (2014.10); *B65D 5/5286* (2013.01); *G09F 1/04* (2013.01)

(56) References Cited

U.S. PATENT DOCUMENTS 1,693,791 A * 12/1928 Liebs ..... B42D 15/045 229/74
1,960,690 A * 5/1934 Blair ..... B42F 1/00 24/17 B
2,323,653 A 7/1943 Fowler, Jr.
2,336,867 A * 12/1943 Huber ..... B42D 15/045 206/215
2,642,182 A 6/1953 Baynes
3,001,690 A * 9/1961 Paterson ..... B42D 15/04 229/92.8
3,104,800 A 9/1963 Johnson et al.
3,190,541 A 6/1965 McLaughlin et al.
3,487,573 A 1/1970 Slovacek
3,624,688 A * 11/1971 Miller ..... G03C 11/14 40/760
3,759,372 A 9/1973 Venema
4,162,800 A * 7/1979 Gonot, Jr. ..... B42D 3/12 116/234
D258,452 S 3/1981 Hewitt et al.
4,632,428 A 12/1986 Brown
4,636,179 A 1/1987 Gentile et al.
5,096,058 A 3/1992 Juravin et al.
5,119,933 A 6/1992 Taylor
5,174,606 A 12/1992 Hure
5,197,663 A 3/1993 Stude
5,237,956 A * 8/1993 Igeta ..... B42D 9/005 116/234
D354,621 S * 1/1995 Holtz ..... D19/1
5,503,434 A 4/1996 Gunn
5,645,214 A 7/1997 Taganas
5,836,507 A 11/1998 Mueller et al.
5,862,979 A 1/1999 Hill et al.
5,931,293 A 8/1999 Seelenmeyer
5,943,800 A * 8/1999 Rose ..... G09F 1/06 40/124.08
5,946,834 A 9/1999 Bradley
5,988,685 A 11/1999 Mogelonsky et al.
6,006,988 A 12/1999 Behrmann et al.
6,082,612 A 7/2000 Black
6,192,661 B1 2/2001 Bodart et al.
6,698,116 B2 * 3/2004 Waldron ..... G09F 1/00 283/99
6,824,066 B2 11/2004 Weyant
6,877,263 B2 4/2005 Clark
6,966,135 B1 11/2005 McDonald
7,024,807 B2 * 4/2006 Street ..... B42D 15/045 283/101
7,204,048 B2 4/2007 Kershner et al.
7,219,829 B2 5/2007 Treat
7,222,446 B2 5/2007 Foster
D597,132 S 7/2009 McDevitt
D691,195 S 10/2013 Klosky
8,650,779 B1 2/2014 Glass et al.
8,707,594 B2 4/2014 Glass et al.
8,813,398 B2 * 8/2014 Dickert ..... B42D 5/027 235/380
2002/0100797 A1 8/2002 Hollingsworth et al.
2005/0247798 A1 11/2005 Graves et al.
2006/0231609 A1 10/2006 Lazarowicz et al.
2006/0255162 A1 11/2006 Nicholas
2007/0152066 A1 7/2007 Colby et al.
2007/0251995 A1 11/2007 Kingsborough et al.
2008/0047173 A1 2/2008 Wilen
2008/0048041 A1 * 2/2008 Riley ..... B42D 15/045 235/487
2008/0116088 A1 5/2008 Roberts
2012/0260542 A1 10/2012 Kibbe et al.
2013/0213833 A1 8/2013 Pruett
2014/0076975 A1 3/2014 Bellmyer et al.

* cited by examiner

GIFT CARD PRESENTER FOR GREETING CARDS

CROSS-REFERENCE TO RELATED APPLICATIONS AND PRIORITY CLAIM

This Non-Provisional Patent Application claims priority benefit of U.S. Non-Provisional patent application Ser. No. 14/669,862, filed Mar. 26, 2015, and titled "GIFT CARD PRESENTER FOR GREETING CARDS," and priority benefit of U.S. Provisional Patent Application No. 61/971,414, filed Mar. 27, 2014, and titled "GIFT CARD PRESENTER FOR GREETING CARDS." Each of these priority applications is incorporated herein by reference in the entirety.

STATEMENT REGARDING FEDERALLY SPONSORED RESEARCH OR DEVELOPMENT

Not applicable.

TECHNICAL FIELD

The present invention generally relates to a presenter for gift cards. More specifically, the present invention relates to a number of different embodiments of a gift card presenter that couples a gift card to a greeting card, allowing any greeting card to carry and present a gift card in an attractive manner.

BACKGROUND

Over the past several years, as our society has gotten more and more active, people have looked for easier and more convenient ways to handle regular tasks. One of these regular tasks is the giving of gifts. Today's consumers are more often giving gift cards in place of actually purchasing a present for someone, for convenience purposes. However, many consumers have expressed guilt for simply giving a gift card, rather than purchasing an actual gift for someone. Some consumers would like to present a gift card to a recipient in a more attractive and personal manner than simply enclosing it in a standard greeting card or envelope. Greeting card companies have responded to this by providing greeting cards designed specifically to hold gift cards. However, gift card holding greeting cards are but a small fraction of the total greeting cards that are produced and they do not utilize the numerous existing designs of greeting cards. Accordingly, there is a need to present gift cards in an attractive manner to express to a recipient an extra effort on behalf of the gift giver and a need to increase the available options of greeting cards with which gift cards may be given. The claimed subject matter presented in this application addresses these needs, among others.

SUMMARY

This summary is provided to introduce a selection of concepts in a simplified form that are further described below in the detailed description section. This summary is not intended to identify key or essential features of the claimed subject matter, nor is it intended to be used as an aid in determining the scope of the claimed subject matter. The scope of the invention is defined by the claims.

Embodiments of the present invention are directed to a gift card presenter for holding a gift card within a greeting card. In a broad aspect, the presenter comprises a body for holding the gift card, and a coupling element for coupling the body to a greeting card. A first half and a second half of the greeting card are separated by a fold line, the first half having an interior face and an exterior face, the second half having an interior face and an exterior face. The first half interior face and the second half interior face are coupled together when the greeting card is in a first closed configuration, and the first half interior face and the second half interior face are uncoupled, apart from the fold line, when the greeting card is in a second open configuration. In one embodiment the body of the presenter may be a paper mechanic for holding the gift card, the paper mechanic coupled to the first and the second interior faces, the paper mechanic collapsing when the greeting card is in the first closed configuration and extending outward when the greeting card is in the second open configuration. The paper mechanic body may be adhered to the first and second interior faces.

In another embodiment the body of the presenter has a first half and a second half separated by a fold line, the first half having an interior face and an exterior face, the second half having an interior face and an exterior face. The first half interior face and the second half interior face are coupled together when the body is in a first closed configuration that at least partially covers the gift card, and the first half interior face and the second half interior face are uncoupled, apart from the fold line, when the body is in a second open configuration that at least partially reveals the gift card. The presenter further comprises a securing element for securing the body to the greeting card.

BRIEF DESCRIPTION OF THE SEVERAL VIEWS OF THE DRAWINGS

The present invention is explained in more detail with reference to the embodiments illustrated in the attached drawing figures, in which like reference numerals denote like elements, wherein.

DETAILED DESCRIPTION

Figure 2:
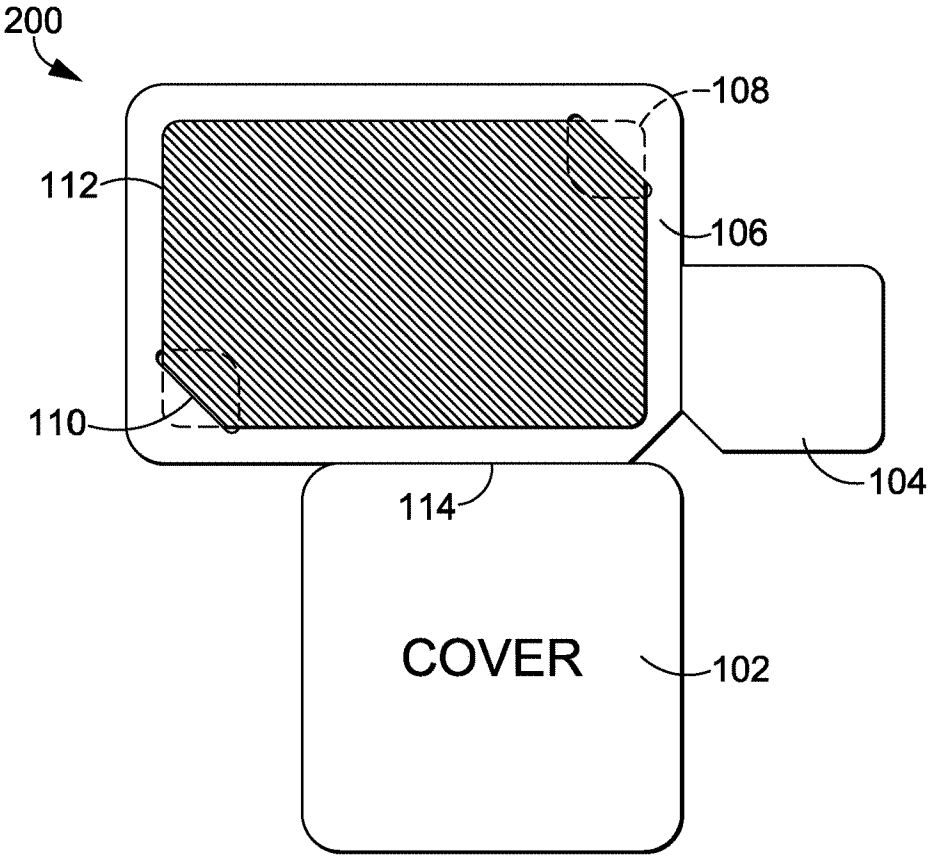
FIG. 2 depicts a top plan view of a cutting diagram of a gift card presenter holding the gift card in a horizontal/landscape orientation, in accordance with an alternate arrangement of the first embodiment of the present invention.

The present invention, in its simplest terms, may be referred to as a "gift card presenter." The presenter is designed to hold a gift card and couple it to a standard greeting card that has not been specifically designed or otherwise modified to hold a gift card. Multiple embodiments of the presenter are described herein.

In a first aspect, the presenter comprises a body for holding a gift card and a coupling element for coupling the body to a greeting card. The body may be formed from die-cut card stock, which may be manipulated to create a desired shape. The body may include one panel or multiple panels separated by fold lines and configured to be folded together about the fold lines to form the desired body shape, which can hold a gift card. A variety of coupling elements may be used to join the body to the greeting card, including a folded portion of the body, an adhesive, or a strap, to name a few. In this regard, the card stock forming the body may be folded to provide a slot, pocket, or opening configured to receive a portion of a greeting card and couple the presenter to the greeting card. The gift card may be coupled or secured to the body by inserting corners of the gift card into die-cut slits cut into the card stock used to form the body. The body may be coupled or affixed to the greeting card at one of a plurality of locations, inside or outside of the greeting card, using any number of affixing components, to provide an attractive presentation of a combination gift card/greeting card.

In one possible embodiment, the body may be formed from paper card stock to provide three panels separated by fold lines. The three panels may comprise a holding panel, to which the gift card may be secured, a cover panel, which may be folded over to cover at least a portion of the gift card and/or the holding panel, and a joining panel, which may be coupled to either the holding panel or the cover panel to connect the panels and provide a pocket for receiving a corner of a greeting card. In this embodiment, the holding panel and the cover panel may be separated by a first fold line, and the holding panel/cover panel and the joining panel may be separated by a second fold line. The gift card may be secured to the body by inserting the edges of the gift card through die-cuts slits in one of the panels (e.g., the holding panel). The panels may be folded together such that at least a portion of the joining panel is between the holding panel and the cover panel. A side or face of the joining panel may be affixed to the cover panel and/or the holding panel. A face or side of the joining panel, the cover panel, and the holding panel may together form at least a portion of the pocket or slot for receiving the greeting card.

The cover panel and/or the holding panel may be configured in different orientations relative to each other. For example, the holding panel may be configured in a vertical/portrait orientation relative to the cover panel, or may be configured in a horizontal/landscape orientation relative to the cover panel (e.g., see FIG. 10), to provide varying presentations of the body within the greeting card and also allow use of the presenter with greeting cards of different shapes, sizes, and layouts.

The body may be formed, folded, or cut into a shape or covering that at least partially covers and holds the gift card, to present the gift card in an attractive or surprising manner when the greeting card is opened. The body may be secured to the greeting card using adhesive, tape, glue, a strap or band, or another similar or analogous securement component. Additionally, the body may be configured to form an ornamental shape, such as a Santa head, an animal, or a house, that obscures or covers at least a portion of the gift card until the ornamental shape is opened, or the gift card is otherwise displayed. A slot or insert holder may be used to secure the gift card to the body. As one example, the gift card may be positioned or secured between two portions of card stock forming the body, the body being coupled to the inside or the outside of a greeting card. Alternatively, the gift card may be inserted into a slot or fold of the body, such that only a portion of the gift card is visible until the greeting card and the body is opened. The body may also include a folded portion with multiple faces, so that the body may be selectively folded around the gift card.

In a second aspect, a gift card presenter for holding a gift card within a greeting card is provided. The presenter comprises a first half and a second half separated by a fold line, the first half having an interior face and an exterior face, the second half having an interior face and an exterior face. The first and second half exterior faces are coupled with interior panels of the greeting card. The first half interior face and the second half interior face are face to face in an abutting or near abutting relationship when the greeting card is in a first closed configuration, and wherein the first half interior face and the second half interior face are apart, separated, uncoupled, or spaced apart when the greeting card is in a second open configuration. The presenter further comprises a paper mechanic for holding the gift card, the paper mechanic coupled to the first and/or the second interior faces of the presenter, the paper mechanic collapsing when the greeting card is in the first closed configuration, and dynamically extending, popping-up, protruding, or moving outward from the first and the second interior faces when the greeting card is dynamically changed to the second open configuration. In this aspect, the movement of the paper mechanic inward and outward during opening of the greeting card provides a pleasing, three-dimensional presentation of the gift card when the greeting card is opened.

The gift card may be suspended or held by the paper mechanic, which may hold the card at a variety of angles or depths in the second configuration. The paper mechanic may include a holder into which the gift card may be inserted, and the holder may be ornamental or decorative. In one exemplary embodiment, the paper mechanic comprises a butterfly that moves its wings as the greeting card is opened and closed. The paper mechanic may also form a string of balloons, an animal, or another type of artwork that changes dynamically when the greeting card is opened and closed. The paper mechanic may have one or multiple anchor points on the interior faces of the greeting card.

In another aspect, a gift card presenter for holding a gift card within a greeting card is provided. The presenter comprises a body for holding the gift card, the body having a first half and a second half separated by a fold line, the first half having an interior face and an exterior face, the second half having an interior face and an exterior face, wherein the first half interior face and the second half interior face are coupled together when the body is in a first closed configuration that at least partially covers the gift card, and wherein the first half interior face and the second half interior face are uncoupled, apart from the fold line, when the body is in a second open configuration that at least partially reveals the gift card. The presenter further comprises a securing element for securing the body to the greeting card.

In this aspect, the body may comprise one of a number of appealing shapes, such as a Santa face, a house, a character, an animal, a scene, or the like. The body may comprise additional surfaces extending from the first and the second halves, the additional surfaces configured to fold over and at least partially cover the gift card and/or the first and/or the second halves of the body. For example, the body may comprise a design with multiple inward folding elements that progressively or selectively cover portions of the greeting card. In this aspect, the first and the second halves of the presenter may be folded together, with the gift card held to an interior face of one of the halves, and a Santa hat attached to one of the halves, the Santa hat configured to be folded over to cover at least a portion of the gift card and/or the first and the second halves. Alternatively, the card may be included as part of the design, with the card showing through a part of the body, with portions of the body cut to cover the gift card and hold it in place. The presenter may be affixed to the greeting card so that when the greeting card is opened, the body and the card are presented together.

In one variation, when the greeting card is in the first closed configuration, the gift card may be partially or fully concealed by the first and/or the second halves of the body, or partially or fully concealed by another portion of the body extending or folded from the edges of the body. The first and second halves may rotate about the fold line to open and close the body to reveal the gift card. The body may hold the gift card between the first and the second halves, or against one of the first and the second halves. For example, the interior surfaces of the body may include one or more slots, pockets, or openings into which the gift card may be inserted to secure the gift card in place against the body. The body may be secured to the inside of the greeting card, such that when the greeting card is opened, the presenter is viewed, and when the presenter is opened, the gift card is revealed.

Figure 1:
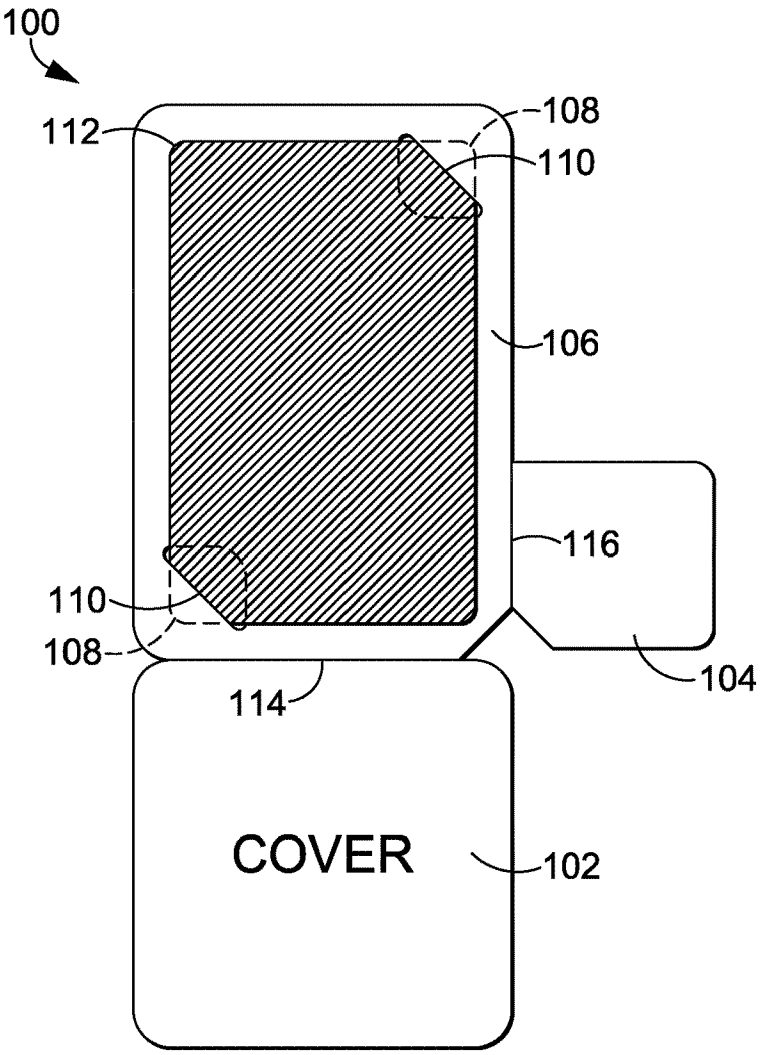
FIG. 1 depicts a top plan view of a cutting diagram of a gift card presenter holding the gift card in a vertical/portrait orientation, in accordance with a first embodiment of the present invention.

The first embodiment of the present invention is a slip-on gift card presenter and is illustrated in FIGS. 1-10. FIG. 1 depicts a cutting diagram of a first embodiment of a gift card presenter 100, arranged to present the gift card in a vertical/portrait orientation relative to a cover panel, in accordance with an embodiment of the present invention. The cutting diagram in FIG. 1 may be used for die-cutting a paper blank into a shape that can be folded into a gift card presenter that can be slid onto a corner of a standard greeting card. In FIG. 1, the presenter 100 includes a cover panel 102, a joining panel 104, and a holding panel 106. The cover panel 102 and the holding panel 106 are joined along a first fold line 114, and the joining panel 104 and the holding panel 106 are joined along a second fold line 116. A gift card 112 is secured to the holding panel 106 by inserting corners or edges 108 of the gift card 112 into slots or openings 110 cut into the holding panel 106.

FIG. 2 depicts a cutting diagram of a second design of the first embodiment of a gift card presenter 200, arranged to present the gift card in a horizontal/landscape orientation relative to the cover panel, in accordance with an aspect of the present invention. As shown in FIG. 2, the paper blank is cut such that it creates a body 200 having three panel portions 102, 104, 106, each of differing sizes. In this regard, the body 200 comprises a cover panel 102, a joining panel 104, and a holding panel 106, the holding panel 106 including slots 110 that receive edges 108 of the gift card 112 to secure the gift card 112 to the holding panel 106. As shown in FIG. 2, the holding panel 106 is oriented horizontally, or in a landscape orientation, with respect to the cover panel 102 to provide a different configuration of the presenter 200 from that of the presenter 100, allowing the presenter 200 to be fitted into different size and style greeting cards. The panels 102, 104, 106 can be folded together to create a pocket or slot for receiving a corner or edge of a greeting card, as discussed above.

Figure 3:
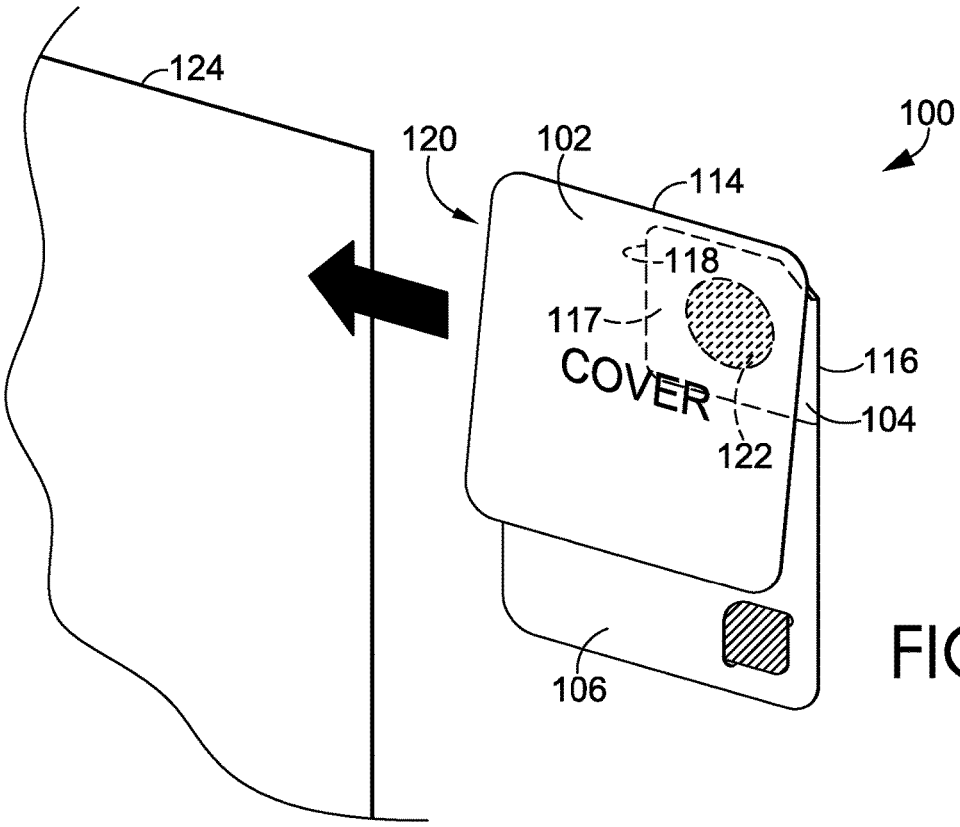
FIG. 3 depicts an front perspective view of the gift card presenter formed from the cutting diagram depicted in FIG. 1, the presenter folded into a desired shape and configured to receive a corner of a greeting card, in accordance with an aspect of the present invention.

FIG. 3 depicts a perspective view of the gift card presenter 100 formed from the cutting diagram depicted in FIG. 1, the presenter 100 being folded into a desired shape and configured to receive a corner of a greeting card. In FIG. 3, the cover panel 102 and holding panel 106 are folded towards each other along the first fold line 114, and the joining panel 104 is folded about the second fold line 116 and positioned at least partially between the cover panel 102 and the holding panel 106. An outward facing surface 117 of the joining panel 104 is coupled to the cover panel 102 with an adhesive 122 (this is but one exemplary bonding/coupling method; others may be used). A space between the cover panel 102, the holding panel 106, and an inward facing surface 118 of the joining panel 104 forms at least a portion of a pocket 120 for receiving a corner of a greeting card 124. In FIG. 3, the presenter 100 may be removably positioned, or secured, to the inner portion of the greeting card 124 by receiving the corner of the greeting card 124 in the pocket 120. In this regard, the presenter 100 can provide an attractive presentation for the gift card 112 inside the greeting card 124, even when the greeting card 124 is not specifically designed to hold a gift card.

Figure 4:
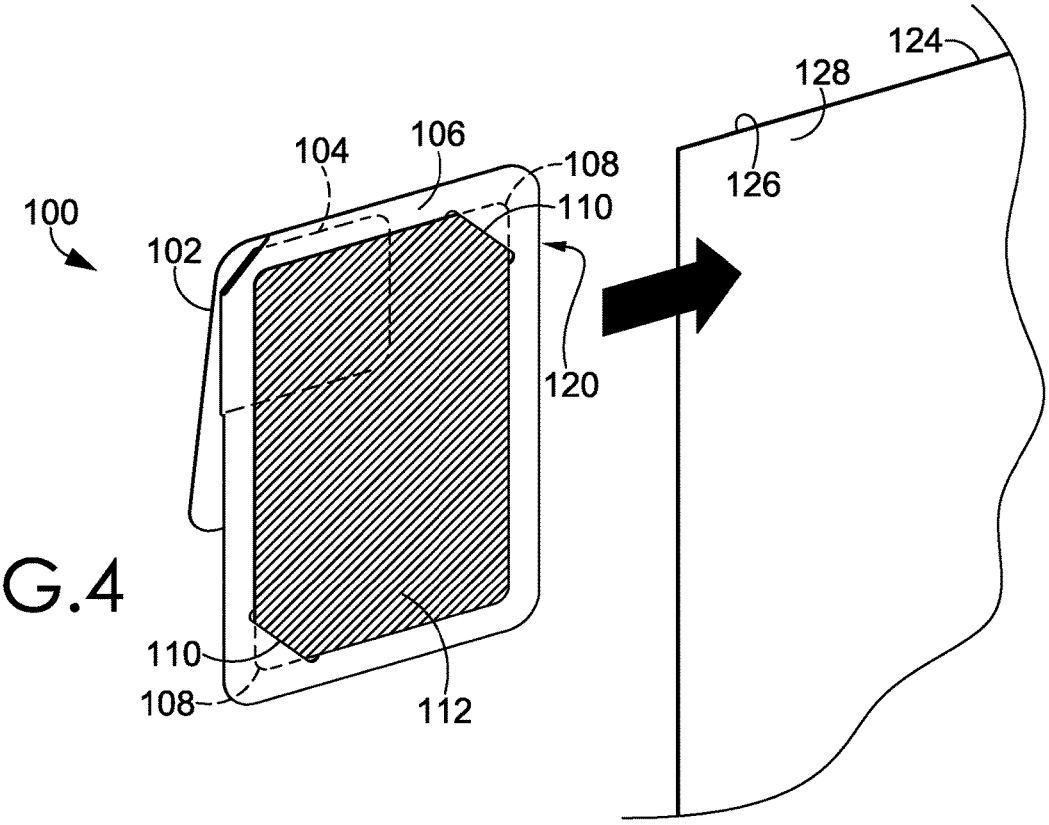
FIG. 4 depicts a rear perspective view of the gift card presenter depicted in FIG. 3, showing the gift card coupled with the presenter, the presenter configured to slide onto the corner of a greeting card, in accordance with an aspect of the present invention.

FIG. 4 depicts a rear perspective view of the gift card presenter 100 depicted in FIG. 3, with a gift card 112 held to the back of the presenter 100 and the presenter configured to receive a corner of the greeting card 124. The holding panel 106 shown in FIG. 4 includes slots 110 for receiving corners 108 of the greeting card 112, the slots 110 holding the greeting card 112 in place against the holding panel 106 of the presenter 100. The cover panel 102, the joining panel 104, and the holding panel 106 form a pocket 120 for receiving a corner of the greeting card 124. If the presenter 100 is received on a front panel of the greeting card 124, the cover panel 102 overlays an exterior surface 126 of the greeting card 124, and the holding panel 106 overlays an interior surface 128 of the greeting card 124.

Figure 5:
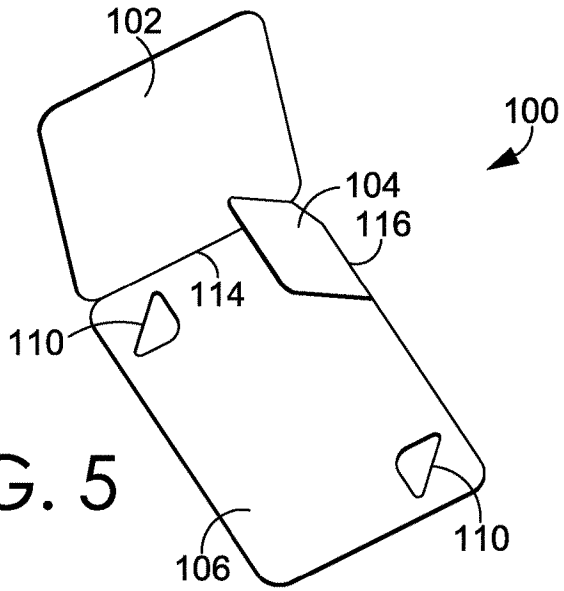
FIG. 5 depicts a perspective view of the gift card presenter formed from the cutting diagram depicted in FIG. 1, with a cover panel and a joining panel folding inward toward a holding panel, in accordance with an aspect of the present invention.
Figure 6:
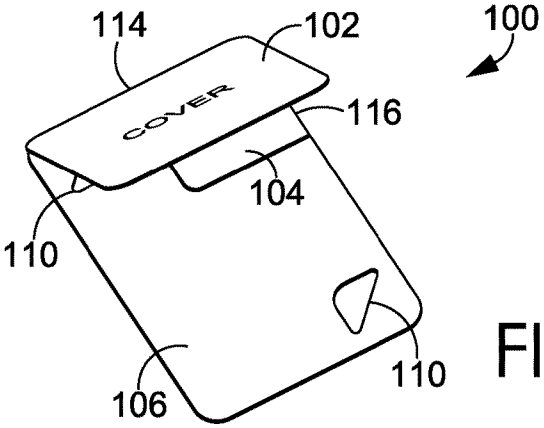
FIG. 6 depicts a perspective view of the gift card presenter depicted in FIG. 5 with the joining panel folded against the holding panel, and the cover panel folded further inward toward the holding panel, in accordance with an aspect of the present invention.
Figure 7:
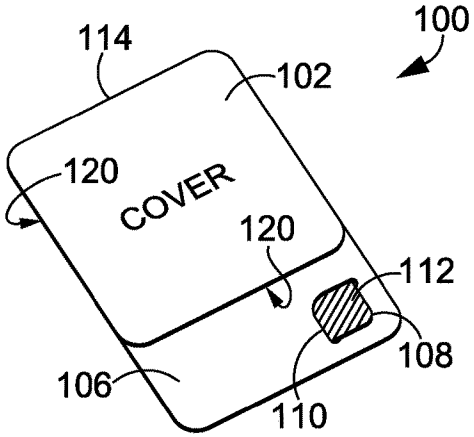
FIG. 7 depicts a perspective view of the gift card presenter depicted in FIG. 6 fully formed and holding a gift card, with the panels folded together to provide a pocket for receiving a corner of a greeting card, in accordance with an aspect of the present invention.
Figure 8:
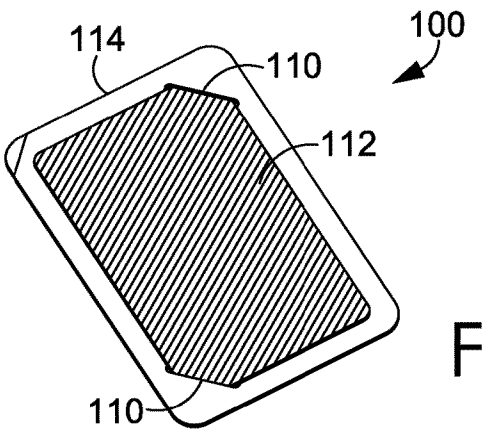
FIG. 8 depicts a rear perspective view of the gift card presenter depicted in FIG. 7, showing the gift card secured to the holding panel of the presenter via die-cut slots, in accordance with an aspect of the present invention.

FIG. 5 depicts a front perspective view of the gift card presenter 100 formed from the cutting diagram depicted in FIG. 1, with the cover panel 102 and the joining panel 104 folded partially inwards towards the holding panel 106 in the forming process. The holding panel 106 includes two die-cut slits 110 for receiving the corners 108 of the gift card 112 to hold the gift card 112 in place against the holding panel 106. This configuration shows the initial formation of the pocket into which a corner of a greeting card may be received. FIG. 6 depicts the same view as depicted in FIG. 5, but with the joining panel 104 and cover panel 102 folded further inward toward the holding panel to illustrate the progression towards forming the pocket for receiving a corner of a greeting card. FIG. 7 depicts the same view as depicted in FIG. 5, but with the presenter 100 fully formed and holding a gift card 112. FIG. 8 depicts a rear perspective view of the gift card presenter 100 depicted in FIG. 7, showing the gift card 112 secured to the holding panel 106 of the presenter 100 by having opposite diagonal corners 108 of the gift card 112 received in the die-cut slots 110.

Figure 9:
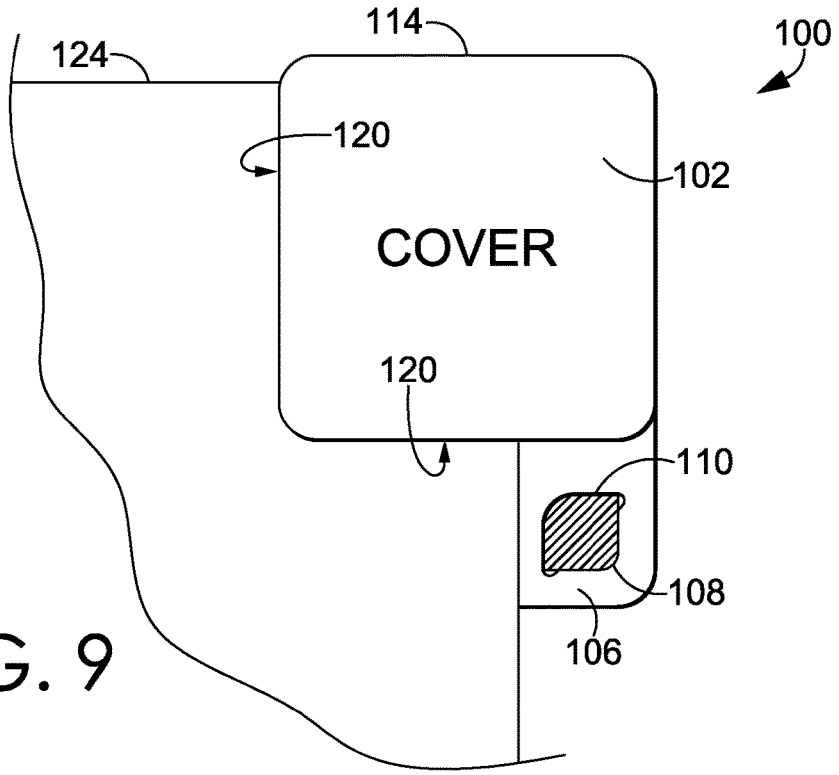
FIG. 9 depicts a front elevation view of the gift card presenter depicted in FIGS. 7-8 received on a corner of a greeting card, in accordance with an aspect of the present invention.
Figure 10:
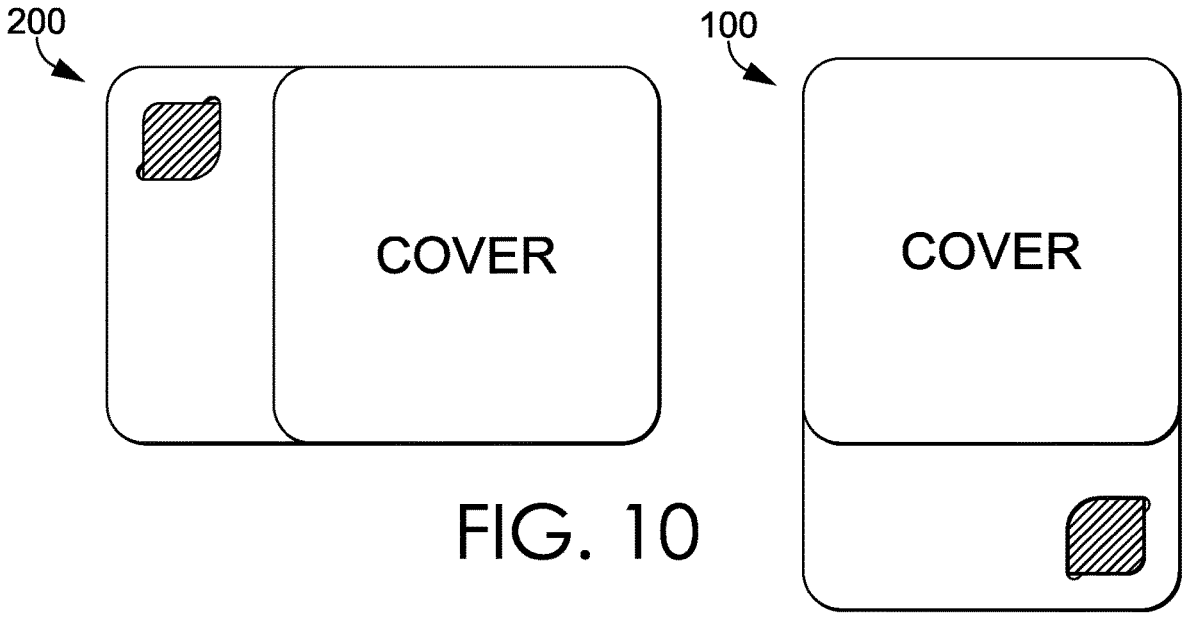
FIG. 10 depicts the gift card presenter of the first embodiment in two alternative configurations, namely, a landscape/horizontal orientation presented on the left, and a vertical/portrait orientation presented on the right, in accordance with an aspect of the present invention.

FIG. 9 is a front elevation view of the gift card presenter 100 depicted in FIGS. 7-8 in use. The presenter 100 is positioned on a corner of the greeting card 124. In FIG. 9, the portrait version of the slip-on presenter 100 is depicted. If the presenter 100 is positioned over a corner of a front panel of the greeting card 124, the cover panel 102 is outside the card 124 and abuts an exterior surface of the greeting card 124. This positions the holding panel 106, and in turn the gift card 112, inside the greeting card 124. If the presenter is positioned over a corner of a rear panel of the greeting card 124, the cover panel is inside the card 124 and is not viewable until the card 124 is opened. This places the holding panel outside the card and in abutting contact with a rear exterior surface of the card 124. The gift card, in that arrangement is also outside the card 124. FIG. 10 depicts two alternate configurations of the gift card presenter 100, namely, a horizontal/landscape orientation 200 presented on the left, and a vertical/portrait orientation 100 presented on the right.

Figure 12:
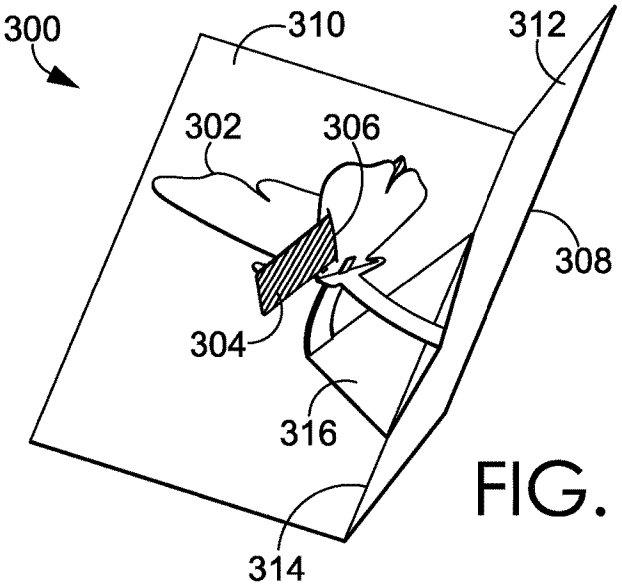
FIG. 12 depicts a right side perspective view of the gift card presenter depicted in FIG. 11, in accordance with an aspect of the present invention.
Figure 11:
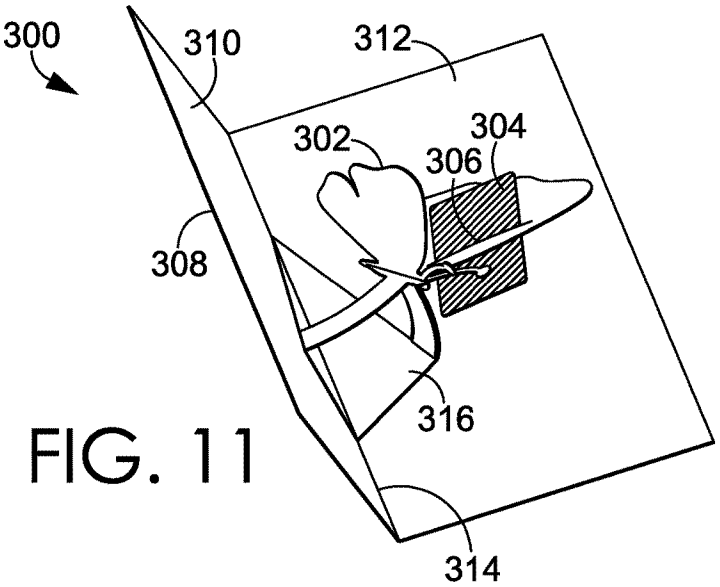
FIG. 11 depicts a left side perspective view of a second embodiment of a gift card presenter featuring a paper mechanic, in accordance with an aspect of the present invention.
Figure 13:
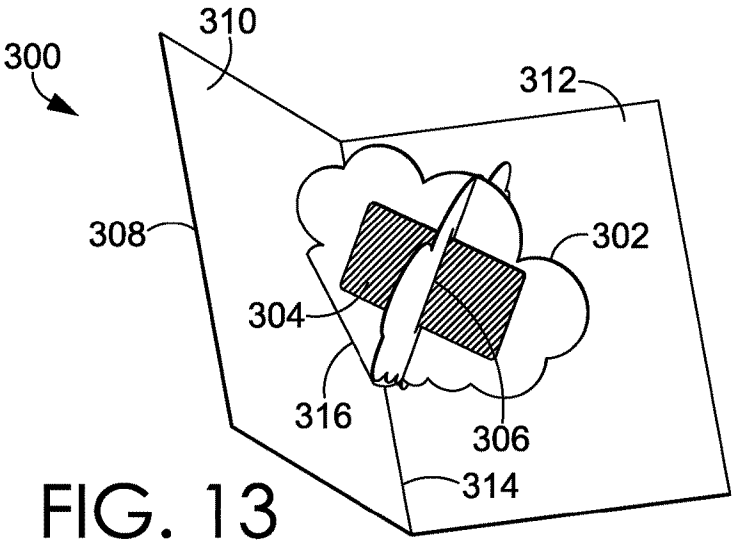
FIG. 13 depicts a front view of an alternative design of the second embodiment of the gift card presenter depicted in FIG. 11, with the paper mechanic featuring an ornamental balloon shape, in accordance with an aspect of the present invention.

FIGS. 11-13 illustrate a second embodiment of a gift card presenter 300 in accordance with an aspect of the present invention. The presenter 300 includes an insert that may be coupled to a standard greeting card. The insert may be a foldable paper mechanic 302 that is coupled to one or more interior surfaces of the greeting card 308 and configured to dynamically move inward and outward to display a gift card 304 when the greeting card 308 goes from a first closed configuration to a second open configuration.

In the illustrated embodiment, the paper mechanic 302 is coupled to a first interior face 310 and a second interior face 312 of the greeting card 308. The first and second interior faces 310, 312 of the greeting card 308 are separated by a fold line 314. The gift card 304 is held in the paper mechanic 302 by a holder 306 through which the gift card 304 may be inserted. The paper mechanic insert 302 further includes a base 316 that is adhered, affixed, or otherwise secured to both the first and the second interior faces 310, 312 of the greeting card 308. When the greeting card 308 is in a first closed configuration, the paper mechanic 302 is collapsed and the gift card 304 likely abuts the first and/or the second interior faces 310, 312. When the greeting card 308 is in a second open configuration, the paper mechanic 302 extends outward as a pop-up, holding the gift card 304 out away from the first and the second interior faces 310, 312, towards the viewer. This provides a pleasing, dynamic presentation of the gift card 304 when the greeting card 308 is opened. The holder 306 of the paper mechanic 302 insert shown in FIGS. 11 and 12 is of a first possible design and is a butterfly with wings that open and close as the greeting card 308 is opened and closed, providing a decorative element. In FIG.

13, the holder 306 of the paper mechanic 302 has an alternate second design comprising an ornamental set of balloons. Numerous other shapes, designs, animals, features, and/or ornamental objects may be employed for variety in the display of the paper mechanic, and the corresponding greeting card without departing from the scope of the present invention.

Figure 15:
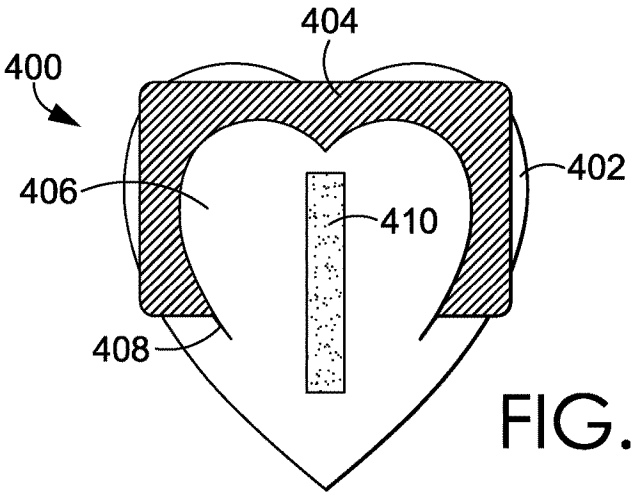
FIG. 15 depicts a rear elevation view of the gift card presenter depicted in FIG. 14, in accordance with an aspect of the present invention.
Figure 14:
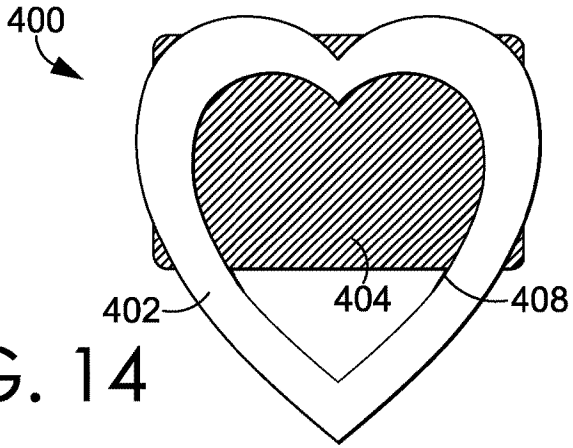
FIG. 14 depicts a front elevation view of a first design of a third embodiment of the gift card presenter described herein, in accordance with an aspect of the present invention.

FIGS. 14-26 depict a third embodiment of the gift card presenter, which can be characterized as a gift card holder that can be adhered to a standard greeting card. FIGS. 14 and 15 depict a first design of the third embodiment of the presenter 400. In FIGS. 14 and 15, the presenter 400 is a heart shape 402. A panel portion 406 is partially die-cut from the heart shape 402, the panel portion 406 providing a slot 408 into which a gift card 404 can be received and held. As shown in FIGS. 14 and 15, the gift card 404 is visible from both sides of the presenter 400. The presenter 400 may be coupled, adhered, or otherwise affixed to an inner or outer portion of a standard greeting card by a coupling element 410. The coupling element 410 may be a strap, an adhesive, adhesive material, double sided tape, part of a hook and loop fastner, a sticker, or any other type of attachment or affixing element, as described herein. FIG. 14 illustrates a front elevational view of the presenter 400, where FIG. 14 illustrates a rear elevation view thereof. The coupling element 410 for affixing the presenter 400 to a selected greeting card is visible in FIG. 15.

Figure 17:
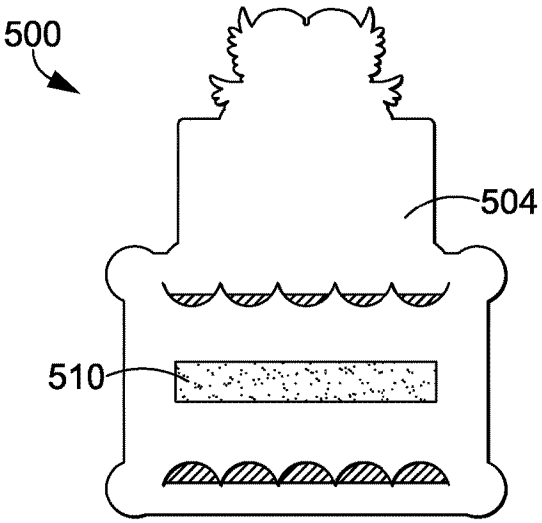
FIG. 17 depicts a rear elevation view of the gift card presenter depicted in FIG. 16, in accordance with an aspect of the present invention.
Figure 16:
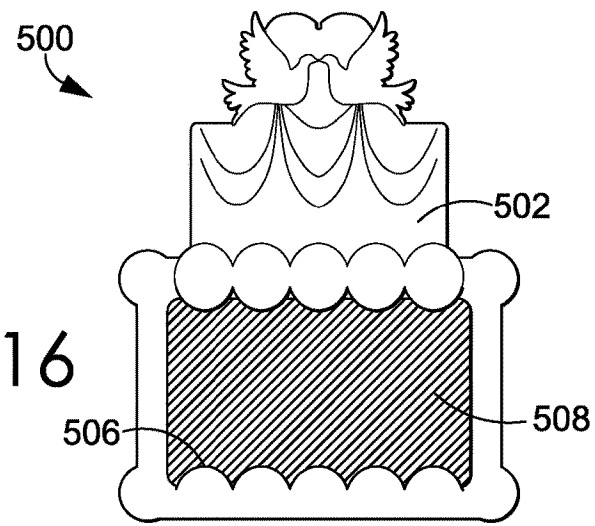
FIG. 16 depicts a front elevation view of a second design of the third embodiment of the gift card presenter described herein, in accordance with an aspect of the present invention.

FIGS. 16 and 17 depict front and rear elevational views of a second design of the third embodiment of the gift card presenter 500, in accordance with an aspect of the present invention. In FIGS. 16 and 17, the presenter 500 is in the shape of a cake with a pair of doves on top of the cake. The "icing" includes die-cut portions 506 designed to be lifted up to permit a gift card 508 to be held in place. The presenter 500 includes a front side 502 and a back side 504, with a cut-out border 506 that forms the icing shape on the front side 502 of the presenter 500. The gift card 508 is held within the border 506, and is primarily visible on the front side 502 of the presenter 500. A coupling element 510 is positioned on the back side 504 of the presenter 500, for securing the presenter 500 to a greeting card.

Figure 18:
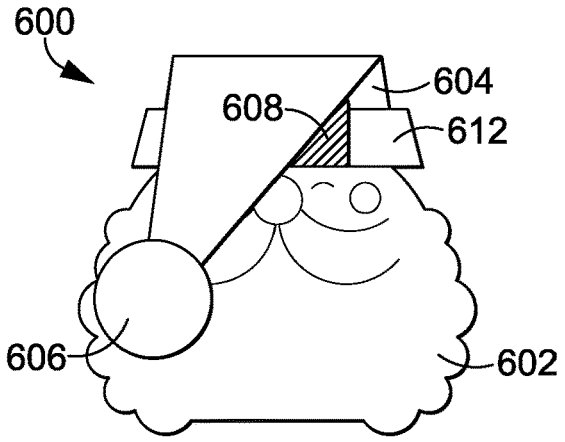
FIG. 18 depicts a front elevation view of a third design of the third embodiment of the gift card presenter described herein, in accordance with an aspect of the present invention.

FIGS. 18-21 depict a third design of the third embodiment of the presenter 600, in accordance with an aspect of the present invention. In FIGS. 18-21, the presenter 600 is in the shape of a head of a Santa Claus. FIG. 18 depicts a front elevation view of the presenter 600 holding a gift card 608 that is received in a slot 612 in a first panel 602. A folded feature 606 in the shape of a Santa hat extends from a second panel 604 and is folded over to partially cover the gift card 608 and/or the first panel 602.

Figure 19:
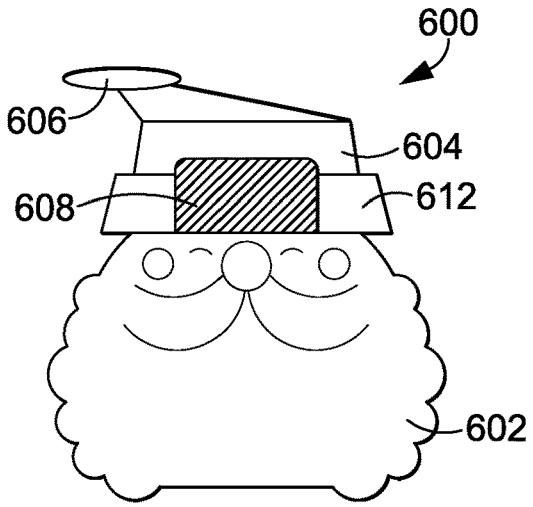
FIG. 19 depicts a front elevation view of the presenter depicted in FIG. 18, with a folded feature of the presenter lifted to reveal a portion of a gift card held therein, in accordance with an aspect of the present invention.
Figure 20:
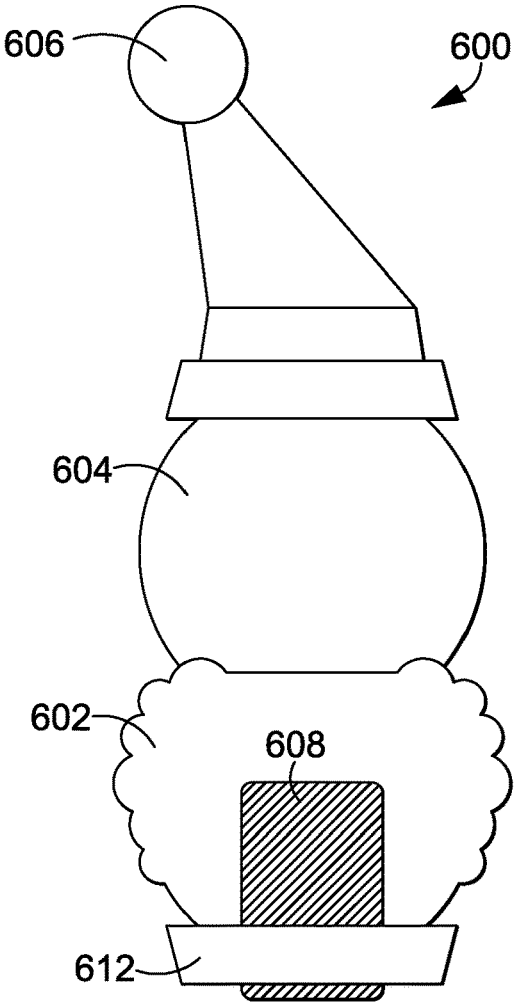
FIG. 20 depicts a front elevation view of the presenter depicted in FIG. 18, with the folded feature of the presenter and a face of the presenter fully opened to reveal the inside of the card and the gift card held therein, in accordance with an aspect of the present invention.

FIG. 19 depicts the same view of the presenter 600 depicted in FIG. 18, but with the folded feature 606 of the presenter 600 lifted to reveal a portion of the gift card 608 held therein. The folded feature 606 of the presenter 600 is partially lifted up to reveal more of the presenter the first and the second panels 602, 604, which are folded together to partially cover the gift card 608. FIG. 20 illustrates the blank that is die-cut to form the presenter 600, and shows how the folded feature 606 of the Santa Claus (i.e., the Santa Hat) and the panels 602, 604 can be folded open.

Figure 21:
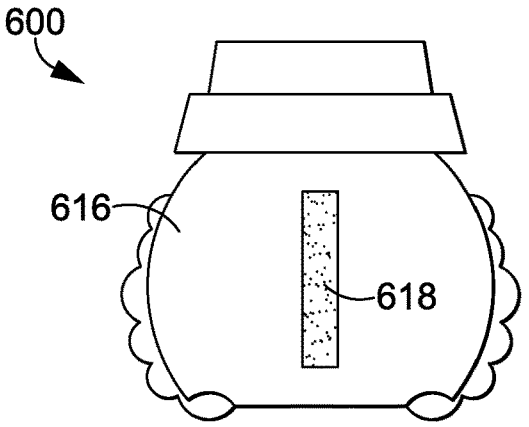
FIG. 21 depicts a rear elevation view of the presenter depicted in FIG. 18, the presenter in a closed configuration, with the gift card concealed from view, in accordance with an aspect of the present invention.

FIG. 21 depicts a rear elevation view of the presenter 600 depicted in FIG. 18. A back side 616 of the presenter 600 may be secured to the inside or outside of a greeting card with a coupling component 618 (e.g., two-sided adhesive tape or an adhesive strip), as shown in FIG. 21.

Figure 22:
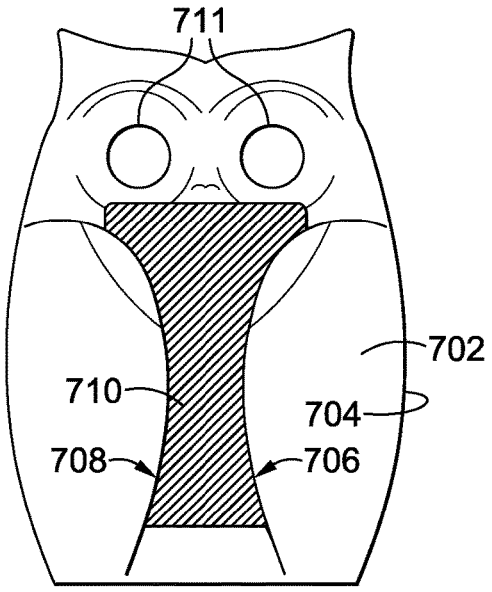
FIG. 22 depicts a front elevation view of a fourth design of the third embodiment of the gift card presenter, in accordance with an aspect of the present invention.
Figure 24:
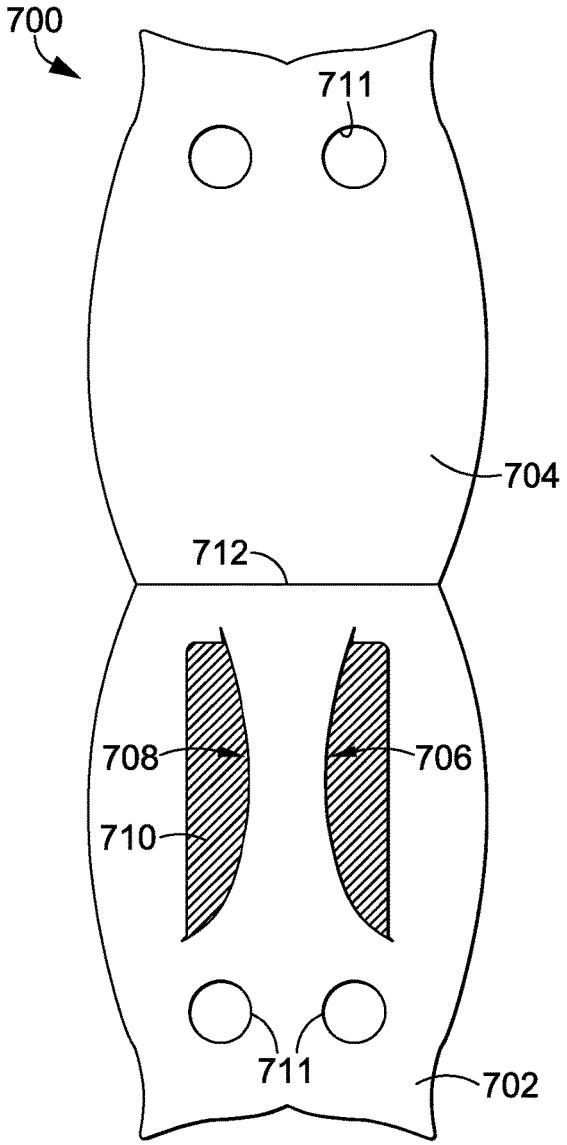
FIG. 24 depicts a front elevation view of the gift card presenter depicted in FIG. 22, with a front panel folded down to reveal the inside of the card, in accordance with an aspect of the present invention.
Figure 23:
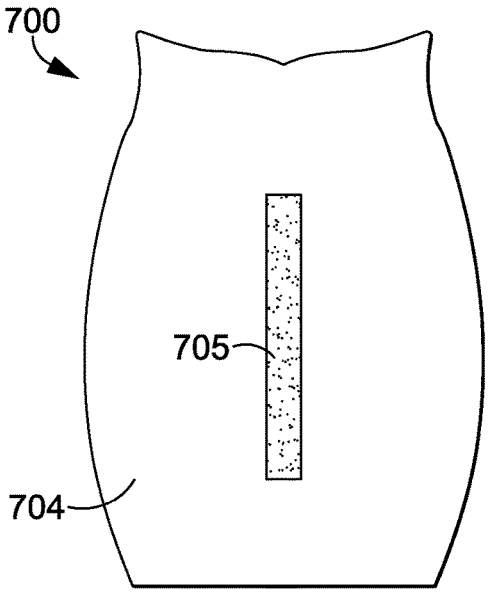
FIG. 23 depicts a rear elevation view of the gift card presenter depicted in FIG. 22, in accordance with an aspect of the present invention.

FIGS. 22-24 depict a fourth design of the third embodiment of the gift card presenter 700, in accordance with an aspect of the present invention. In FIG. 22, the presenter 700 is in the shape of an owl, with the wings of the owl die-cut in the presenter 700. The presenter 700 has a front panel 702 connected to a back panel 704 along a fold line 712. First and second slots 706, 708 are cut into the front panel 702 for receiving and holding a gift card 710. Apertures are cut through the front and back panels 702, 704 to form a pair of eyes 711. FIG. 23 depicts a rear view of the presenter 700 shown in FIG. 22 and illustrates a back side of the back panel 704 of the presenter 700. The back side of the back panel 704 may be secured to the inside or the outside of a greeting card with a coupling component or securing element 705, as shown in FIG. 23. FIG. 24 illustrates the blank that is die-cut to form the gift card presenter 700 depicted in FIGS. 22-23. The first and the second panels 702, 704 may be folded open and closed to reveal and/or hide the gift card 720 and additional sentiment/artwork.

Figure 26:
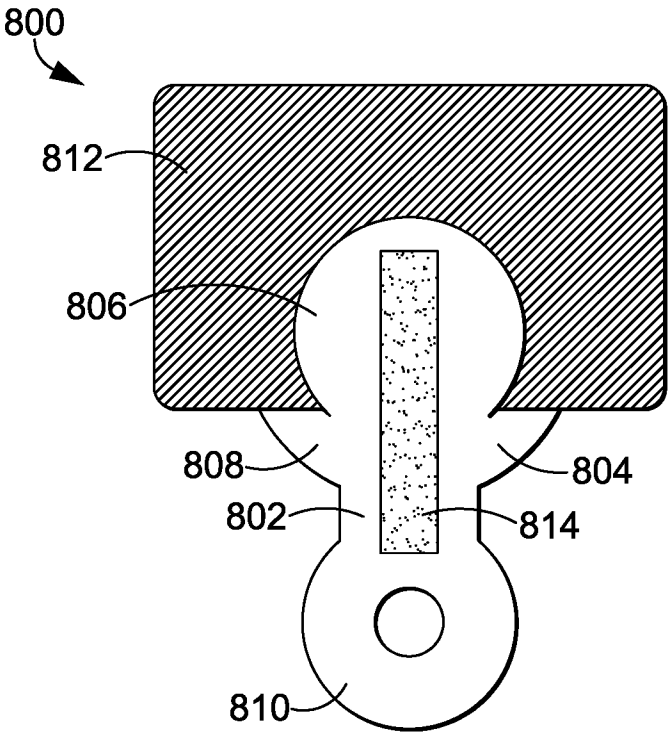
FIG. 26 depicts a rear elevation view of the gift card presenter depicted in FIG. 25, in accordance with an aspect of the present invention.
Figure 25:
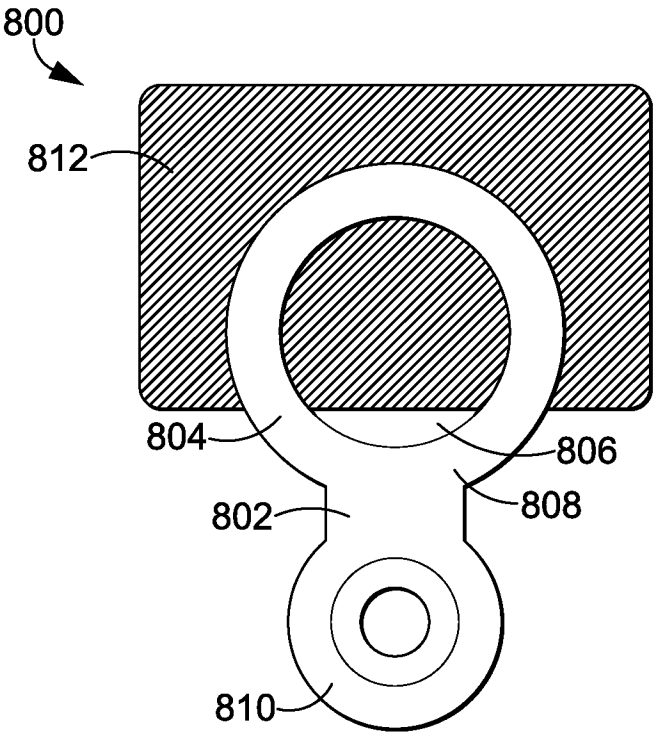
FIG. 25 depicts a front elevation view of a fifth design of the third embodiment of the gift card presenter, in accordance with an aspect of the present invention.

FIGS. 25 and 26 depict front and rear elevation views of a fifth design of the third embodiment of the gift card presenter 800, in accordance with an aspect of the present invention. The presenter 800 includes a body 802 that is in the shape of a baby rattle. The body 802 includes a first portion 804 and a second portion 810. The first portion 804 is partially die-cut to provide a first panel 806 and a second panel 808 for receiving a gift card 812 there between with the second panel 808 surrounding the first panel 806. The gift card 812 is positioned and secured between the first and the second panels 806, 808 for presentation. As illustrated in FIG. 26, a coupling component or securing element 814 (e.g., double-sided tape) is positioned on a rear of the first and/or second portions 804, 810 of the presenter 800 for securing the same to a greeting card.

Figure 27:
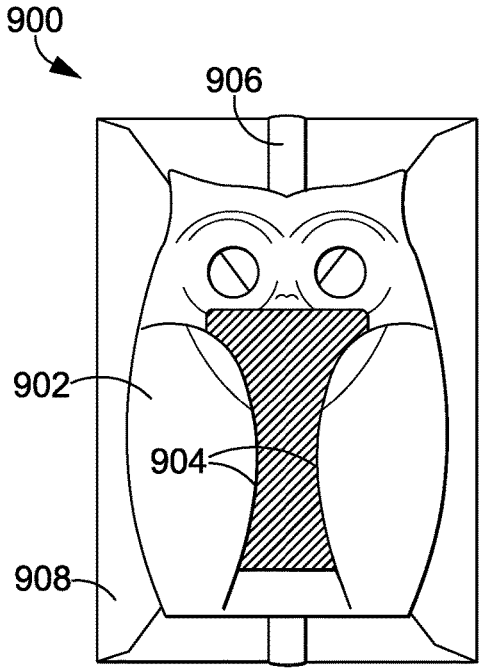
FIG. 27 depicts a front elevation view of a first design of a fourth embodiment of the gift card presenter described herein, the presenter comprising the front panel of the fourth design of the third embodiment depicted in FIG. 22 coupled to a greeting card with a strap, in accordance with an aspect of the present invention.
Figure 28:
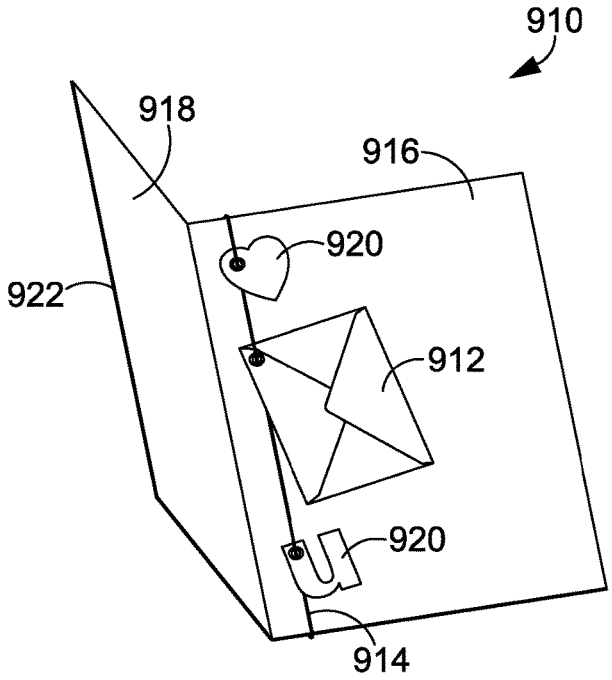
FIG. 28 depicts a front perspective view of a second design of the fourth embodiment of the gift card presenter described herein, the presenter including decorative elements received on a strap coupled to the interior of a greeting card, in accordance with an aspect of the present invention.
Figure 29:
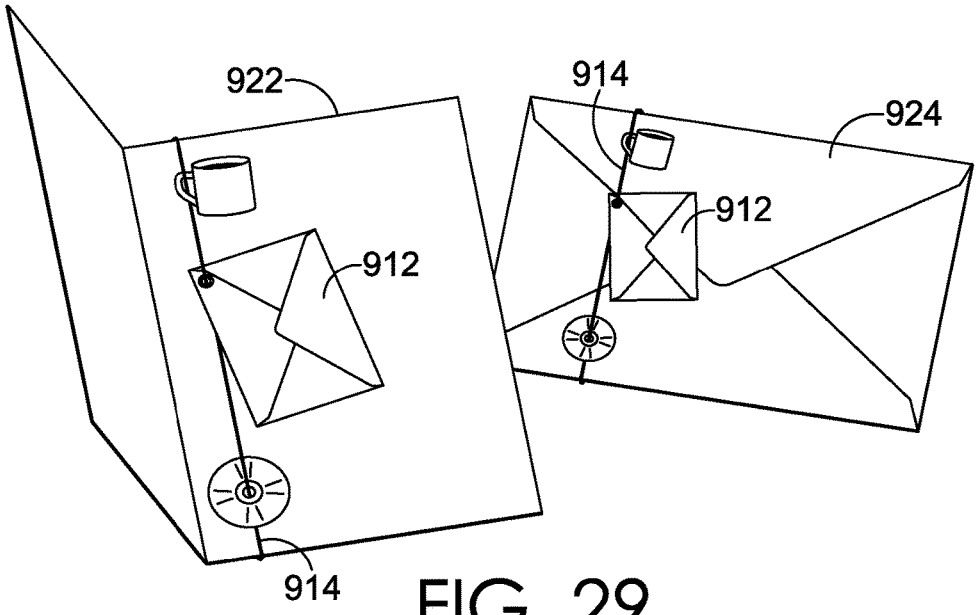
FIG. 29 depicts front perspective views of a third design of the fourth embodiment of the gift card presenter in two alternate configurations, one with the presenter coupled to the interior of a greeting card and one with the presenter coupled to an exterior of a greeting card, in accordance with an aspect of the present invention.

FIGS. 27-29 depict multiple designs of a fourth embodiment of a gift card presenter, in accordance with an aspect of the present invention. In FIG. 27, a gift card presenter 900 is depicted that includes a body 902 having die-cut slots 904 therein for holding a gift card. The body 902 is coupleable to a greeting card 908 with a strap, cord, lace, or other securing component 906. The gift card presenter 900 may be the gift card presenter 700 of FIGS. 22-24 with the securing component 906 replacing the coupling component or securing element 705 or may be simply the front panel 702 of the presenter 700.

In FIG. 28, an alternate gift card presenter 910 is depicted, in which a body 912 having the shape of an envelope covers a gift card and is coupled to a greeting card 922 with a strap 914. In the illustrated embodiment, the strap 914 couples the body 912 to a first interior face 916 of the greeting card 922, which is opposite a second interior face 918 of the greeting card 922. The strap 914 includes decorative elements 920 that add a pleasing, colorful, and visual component to the presenter 910. In FIG. 29, two alternate placements of the presenter 910 are shown. On the left the presenter is coupled with the card 922, whereas on the right the presenter 910 is placed around an envelope 924 that hold the card 922. The presenter 910 in FIG. 29 uses alternate decorative elements 920.

It should be noted that while the invention has been described and illustrated in the context of gift cards and greeting cards, it is not so limited. The gift card presenter of the present invention may be used with all types of merchandise, such as, but not limited to, stationery, invitations, books, journals, giftwrap, paper, folders, pictures, etc.

Embodiments of the present invention have been described with the intent to be illustrative rather than restrictive. Alternative embodiments will become apparent to those skilled in the art that do not depart from the scope of the invention. A skilled artisan may develop alternative means of implementing the aforementioned improvements without departing from the scope of the present invention. It will be understood that certain features and subcombinations are of utility and may be employed without reference to other features and subcombinations and are contemplated as within the scope of the claims.

What is claimed is:

1. An assembly for coupling a gift card to a greeting card, the assembly comprising:

a gift card presenter comprising:

a body comprising one or more slots adapted for receiving and holding the gift card, a coupling element coupled to the body and adapted for coupling the gift card presenter to the greeting card, wherein the coupling element comprises a strap sized to be coupled about the greeting card, allowing the gift card presenter to be positioned so that a portion of the greeting card can be folded to at least partially cover the gift card presenter, and wherein the body and the coupling element are seperate structures that are coupled together to form the gift card presenter.

2. The assembly of claim 1, wherein the coupling element allows the body to be coupled to the greeting card by coupling the strap about the greeting card.

3. The assembly of claim 1, wherein when the portion of the greeting card is folded, a portion of the strap is visible and a portion of the body is not visible.

4. The assembly of claim 1, wherein the strap is useable for securing the gift card presenter to the greeting card so that the portion of the greeting card can be folded to cover only a portion of the strap and not the body.

5. The assembly of claim 1, wherein the one or more slots comprises four slots.

6. The assembly of claim 1, wherein the body includes a foldable portion that can be folded to at least partially cover the gift card when the gift card is coupled to the body.

7. The assembly of claim 1, wherein the one or more slots comprises at least one curved slot.

8. A method of coupling a gift card presenter adapted for holding a gift card to a greeting card, the method comprising:

coupling the gift card to a body of the gift card presenter the gift card presenter comprising:

the body comprising one or more slots adapted for receiving and holding the gift card, and a coupling element attached to the body and adapted for coupling the gift card presenter to the greeting card, wherein the coupling element comprises a strap sized to be coupled about the greeting card, and wherein coupling the gift card to the body comprises inserting the gift card at least partially into the one or more slots;

coupling the gift card presenter to the greeting card by coupling the strap about a portion of the greeting card so that the greeting card can be folded to at least partially cover the gift presenter, wherein the body and the coupling element are seperate structures that are coupled together to form the gift card presenter.

9. The method of claim 8, further comprising folding the greeting card to at least partially cover the gift card presenter.

10. The method of claim 9, wherein folding the greeting card fully covers the body.

11. The method of claim 8, wherein the one or more slots comprises four slots.

12. The method of claim 8, wherein the body includes a foldable portion that can be folded to at least partially cover the gift card when the gift card is coupled to the body.

13. The method of claim 8, wherein the one or more slots comprises at least one curved slot.

14. A method of assembling a gift card presenter used for attaching a gift card to a greeting card, the method comprising:

forming a body of the gift card presenter, the body comprising one or more slots adapted for receiving and holding the gift card;

forming a coupling element useable for coupling the gift card presenter to the greeting card, the coupling element comprising a strap;

attaching the strap to the body;

coupling the body to the greeting card by coupling the strap about a portion of the greeting card;

folding the greeting card to at least partially cover the gift card presenter, wherein the body and the coupling elemente are seperate structures that are coupled together to form the gift card presenter.

* * * * *